US009913780B2

(12) United States Patent
Quackenbush

(10) Patent No.: US 9,913,780 B2
(45) Date of Patent: Mar. 13, 2018

(54) BITE-SAFE ARTIFICIAL TEAT

(71) Applicant: Carr Lane Quackenbush, Monson, MA (US)

(72) Inventor: Carr Lane Quackenbush, Monson, MA (US)

( * ) Notice: Subject to any disclaimer, the term of this patent is extended or adjusted under 35 U.S.C. 154(b) by 0 days.

(21) Appl. No.: 15/215,881

(22) Filed: Jul. 21, 2016

(65) Prior Publication Data

US 2018/0021222 A1 Jan. 25, 2018

(51) Int. Cl.

*A61J 11/00* (2006.01)
*A61J 11/02* (2006.01)
*A61J 11/04* (2006.01)

(52) U.S. Cl.

CPC ..... *A61J 11/0065* (2013.01); *A61J 11/002* (2013.01); *A61J 11/02* (2013.01); *A61J 11/045* (2013.01)

(58) Field of Classification Search

CPC ..... A61J 11/002; A61J 9/00; A61J 11/0005; A61J 9/006; A61J 11/001

USPC ..... 215/11.1, 11.3, 11.4, 11.5; 606/236, 234

See application file for complete search history.

(56) References Cited

U.S. PATENT DOCUMENTS 589,212 A 8/1897 Michael
605,161 A 6/1898 Clement et al.
633,343 A 9/1899 Heany
686,109 A 11/1901 Muelhens
1,146,639 A 7/1915 Miller
1,280,942 A 10/1918 Apple
1,545,436 A 7/1925 Mcgeary
1,569,693 A 1/1926 Young
1,588,846 A 6/1926 Mcgeary
1,590,152 A 6/1926 Sylvain
1,632,854 A 6/1927 Rogers
1,656,157 A 1/1928 Correnti (Continued)

FOREIGN PATENT DOCUMENTS

CH 698785 B1 10/2009
DE 4133064 A1 4/1993

(Continued)

OTHER PUBLICATIONS

International Search Report for International Application No. PCT/US2017/043044 dated Oct. 29, 2017.

(Continued)

*Primary Examiner* — Fenn C Mathew
*Assistant Examiner* — Cynthia Collado
(74) *Attorney, Agent, or Firm* — McCormick, Paulding & Huber LLP

(57) ABSTRACT

A bite-safe artificial nipple is constructed of polymeric materials sufficiently soft and elastic to replicate a nursing mother's nipple tissue. Added to the soft, elastic matrix phase is a braided fibrous mesh tube to prevent a small bitten-off portion of the nipple from becoming separated from the rest of the teat, thereby preventing a choking hazard. The braided fibrous mesh tube is arranged in a very specific configuration, so that it experiences neither tension nor compression as the teat is compressed or elongated in use and so does not act to "reinforce" the soft, elastic matrix phase which would otherwise create a classic load-transfer composite destroying the soft, elastic properties of the matrix phase needed for the desired functioning of the artificial teat.

22 Claims, 6 Drawing Sheets

(56) References Cited

U.S. PATENT DOCUMENTS

| | | | |
|---|---|---|---|
| 1,572,734 | A | 6/1928 | Reilly |
| 1,672,466 | A | 6/1928 | Benjamin et al. |
| 1,848,533 | A | 3/1932 | Lasky |
| 1,859,733 | A | 5/1932 | Lynn |
| 1,913,627 | A | 6/1933 | Epstein |
| 1,989,060 | A | 1/1935 | Liddick |
| 2,001,842 | A | 5/1935 | Heise et al. |
| 2,005,437 | A | 6/1935 | Naum |
| 2,060,212 | A | 11/1936 | Herstein |
| 2,321,236 | A | 6/1943 | Victer |
| 2,366,214 | A | 1/1945 | Ramaker |
| 2,495,548 | A | 1/1950 | Revane |
| 2,638,094 | A | 5/1953 | Joseph |
| 2,655,920 | A | 10/1953 | Cronin |
| 2,825,479 | A | 3/1958 | Raiche |
| 2,825,749 | A | 3/1958 | Litzie |
| 2,889,829 | A | 6/1959 | Tannenbaum et al. |
| 3,022,915 | A | 2/1962 | Mulin |
| 3,070,249 | A | 12/1962 | Schrwald |
| 3,082,770 | A | 3/1963 | Straub |
| 3,126,116 | A | 3/1964 | Clinehens |
| 3,139,064 | A | 6/1964 | Harle |
| 3,190,288 | A | 6/1965 | Butler et al. |
| 3,193,125 | A | 7/1965 | Fischer |
| 3,424,157 | A | 1/1969 | Di Paolo |
| 3,530,979 | A | 9/1970 | Merrill, Jr. et al. |
| 3,593,870 | A | 7/1971 | Anderson |
| 3,645,413 | A | 2/1972 | Mitchell |
| 3,650,270 | A | 3/1972 | Frazier |
| 3,661,288 | A | 5/1972 | Noll |
| 3,777,753 | A | 12/1973 | Kesselring et al. |
| 3,779,413 | A | 12/1973 | Pickerell et al. |
| 3,787,993 | A | 1/1974 | Lyon |
| 3,790,016 | A | 2/1974 | Kron |
| 3,790,017 | A | 2/1974 | Fitzpatrick et al. |
| 3,858,741 | A | 1/1975 | Smith, Sr. |
| 3,946,888 | A | 3/1976 | Tonkin |
| 4,006,836 | A | 2/1977 | Micallef |
| 4,195,638 | A | 4/1980 | Duckstein |
| 4,238,040 | A | 12/1980 | Fitzpatrick |
| 4,311,245 | A | 1/1982 | Maffei |
| D273,515 | S | 4/1984 | Fabjancic |
| 4,505,398 | A | 3/1985 | Kesselring |
| 4,532,163 | A | 7/1985 | Hoppie |
| 4,586,621 | A | 5/1986 | Dahan |
| 4,619,271 | A | 10/1986 | Burger et al. |
| 4,623,069 | A | 11/1986 | White |
| 4,676,386 | A | 6/1987 | Phlaphongphanich |
| 4,688,571 | A | 8/1987 | Tesler |
| 4,700,856 | A | 10/1987 | Campbell et al. |
| 4,759,139 | A | 7/1988 | Ricks |
| 4,815,615 | A | 3/1989 | Phlaphongphanich |
| 4,832,214 | A | 5/1989 | Schrader |
| 4,834,099 | A | 5/1989 | Schrooten |
| 4,881,553 | A | 11/1989 | Grossman |
| 4,941,573 | A | 7/1990 | Fuerstman |
| 4,993,568 | A | 2/1991 | Morifuji et al. |
| 5,004,473 | A | 4/1991 | Kalantar |
| 5,013,321 | A | 5/1991 | MacVane |
| 5,035,340 | A | 7/1991 | Timmons |
| 5,069,351 | A | 12/1991 | Gunderson et al. |
| 5,072,842 | A | 12/1991 | White |
| 5,085,349 | A | 2/1992 | Fawcett |
| 5,101,991 | A | 4/1992 | Morifuji et al. |
| 5,114,374 | A | 5/1992 | Estiva |
| 5,117,994 | A | 6/1992 | Leblanc et al. |
| D330,938 | S | 11/1992 | Sakashita |
| 5,207,338 | A | 5/1993 | Sandhu |
| 5,322,031 | A | 6/1994 | Lerner et al. |
| 5,474,028 | A | 12/1995 | Larson et al. |
| D371,848 | S | 7/1996 | Searles |
| 5,535,899 | A | 7/1996 | Carlson |
| 5,542,922 | A | 8/1996 | Petterson et al. |
| 5,544,766 | A | 8/1996 | Dunn et al. |
| 5,553,726 | A | 9/1996 | Park |
| 5,598,809 | A | 2/1997 | McInnes |
| 5,630,806 | A | 5/1997 | Inagaki et al. |
| 5,673,806 | A | 10/1997 | Busnel |
| 5,688,328 | A | 11/1997 | Tong et al. |
| 5,690,679 | A | 11/1997 | Prentiss |
| D417,735 | S | 12/1999 | Ford |
| 6,003,698 | A | 12/1999 | Morano |
| 6,032,810 | A | 3/2000 | Meyers et al. |
| 6,161,710 | A | 12/2000 | Dieringer et al. |
| 6,253,935 | B1 | 7/2001 | Fletcher |
| 6,270,519 | B1 | 8/2001 | Botts |
| 6,343,704 | B1 | 2/2002 | Prentiss |
| 6,588,613 | B1 * | 7/2003 | Pechenik ..... A61J 11/001 215/11.1 |
| 6,645,228 | B2 | 11/2003 | Renz |
| 6,675,981 | B1 | 1/2004 | Lesko |
| 6,736,830 | B2 | 5/2004 | Roust |
| 6,745,912 | B2 | 6/2004 | Uehara et al. |
| 6,818,162 | B1 | 11/2004 | Hoffman et al. |
| 6,871,751 | B2 | 3/2005 | Kerns et al. |
| 6,883,672 | B2 | 4/2005 | Dunn et al. |
| 6,968,964 | B2 | 11/2005 | Gilmore |
| 7,287,657 | B1 | 10/2007 | Rodriguez |
| 7,395,941 | B2 | 7/2008 | Hong |
| 8,448,796 | B2 | 5/2013 | Silver |
| 8,646,632 | B2 * | 2/2014 | Vischer ..... A61J 11/0065 128/859 |
| 8,961,562 | B2 | 2/2015 | Randolph et al. |
| 2003/0032984 | A1 * | 2/2003 | Hakim ..... A61J 11/0055 606/234 |
| 2003/0089676 | A1 | 5/2003 | Uehara et al. |
| 2003/0093121 | A1 * | 5/2003 | Randolph ..... A61J 11/0035 606/236 |
| 2004/0045922 | A1 | 3/2004 | Holley |
| 2004/0124168 | A1 | 7/2004 | Silver |
| 2004/0182813 | A1 | 9/2004 | Gilmore |
| 2004/0220323 | A1 * | 11/2004 | Gu ..... C08L 53/02 524/515 |
| 2004/0220618 | A1 | 11/2004 | Rohrig |
| 2004/0245203 | A1 | 12/2004 | Goldman et al. |
| 2005/0258123 | A1 * | 11/2005 | Silver ..... A61J 11/001 215/11.1 |
| 2006/0011571 | A1 | 1/2006 | Silver |
| 2008/0314776 | A1 | 12/2008 | Cooke |
| 2011/0017696 | A1 | 1/2011 | Elad et al. |
| 2011/0100944 | A1 | 5/2011 | Van Der Kooi et al. |
| 2011/0168656 | A1 | 7/2011 | Itzek |
| 2011/0240586 | A1 * | 10/2011 | Silver ..... A61J 11/005 215/11.1 |
| 2012/0043293 | A1 | 2/2012 | Bryan et al. |
| 2014/0124469 | A1 | 5/2014 | Richard |

FOREIGN PATENT DOCUMENTS

| | | | |
|---|---|---|---|
| EP | 384394 | B1 | 8/1994 |
| GB | 976612 | A | 12/1964 |
| KR | 0137262 | | 3/1999 |
| WO | 1995032702 | | 12/1995 |
| WO | 2007137885 | A1 | 12/2007 |
| WO | 2010106346 | A1 | 1/2012 |

OTHER PUBLICATIONS

Written Opinion for International Application No. PCT/US2017/043044 dated Oct. 29, 2017.

* cited by examiner

Conventional artificial nippie

| | inch | mm |
|---|---|---|
| A | 2.1 | 53.34 |
| B | 1.78 | 45.21 |
| C | 0.50 | 12.70 |
| D | 0.075 | 1.91 |
| E | 1.84 | 46.61 |
| F | 1.00 | 25.40 |
| G | 0.84 | 21.21 |
| H | 0.04 | 1.07 |
| I | 0.42 | 10.57 |

for x = 1.5

| $D_r$ = diameter of relaxed mesh tube | $P_r$ = fiber pitch relaxed, (mm) |
|---|---|
| 7.00 | 11.36 |
| 8.00 | 12.98 |
| 9.00 | 14.60 |
| 10.00 | 16.22 |
| 11.00 | 17.85 |
| 12.00 | 19.47 |
| 13.00 | 21.09 |
| 14.00 | 22.71 |

| Sample | Elongation at 15 PSI | Calculated fiber stretch @ 1.5 x elongation |
|---|---|---|
| **Shore A 10 with:** | | |
| No braid ("desirable") | 1.5 | N/A |
| Braid @ 108% of "correct" pitch | 1.5 | 2% |
| Braid @ 125% of "correct" pitch | 1.22 | 6% |
| Braid @ 174% of "correct" pitch | 1.02 | nill |
| Shore A 60, no braid ("undesirable") | 1.14 | N/A |

BITE-SAFE ARTIFICIAL TEAT

TECHNICAL FIELD

The present invention relates generally to a device for infant feeding and, more particularly, to artificial teats or nipples for feeding infants that are designed to mimic natural teats.

DESCRIPTION OF THE RELATED ART

Newborns and infants experience many benefits from breast-milk feeding that are well documented. These benefits include providing protection against many illnesses caused by allergies, bacteria and viruses, such as stomach viruses, respiratory illness, ear infections, meningitis and the like. (See Fallot M E, Boyd J L, Oski F A. Breast-feeding reduces incidence of hospital admissions for infection in infants; Pediatrics. 1980, 65:1121-1124). Breast milk feeding also may increase intelligence and fight obesity.

There are also benefits for mothers, as twenty-four cumulative months of breast-feeding are reputed to halve the risks of breast cancer and osteoporosis.

Breast milk can be extracted using any of a number of commercially available breast pumps and fed to the infant using a bottle fitted with an artificial teat. Artificial teats of conventional design (see for example, FIG. 1) are hollow and contain one or a number of fixed-orifice hole(s) at the tip. These teats are typically constructed of silicone rubber with a Shore A hardness in the range of 50 to 70. Such material has hardness and stiffness significantly higher than a mother's breast/nipple. Because of this difference, conventional artificial nipples cannot closely mimic the form and function of a nursing mother's breast/nipple.

Additionally, obstruction of the infant's airways is an ever-present danger for feeding infants with an artificial teat. Specifically, any part liberated from the artificial teat, if sufficiently small, can create a choking hazard.

Therefore, it is desirous to provide an improved approach to artificial teats free of choking hazards.

SUMMARY OF THE APPLICATION

During nursing, a mother's nipple elasticity elongates until it seats into the downward curve of the hard palate near the back of the baby's mouth. (See McClellan, H. L., Sakalidis, V. S., Hepworth, A. R., Hartmann, P. E. and Geddes, D. T. Validation of Teat Diameter and Tongue Movement Measurements with B-Mode Ultrasound During Breastfeeding. Ultrasound in Medicine & Biology; 2010 36 (11): 1797-1807). The total elongation depends on the geometry of a particular infant's mouth and geometry of the mother's relaxed nipple. This elongation has been reported to be as much as two times the relaxed nipple length. (See Smith, W. L., Erenberg, A. and Nowak, A. J. Imaging Evaluation of the Human Nipple During Breastfeeding; Am J Diseases in Children; 1988 142: 76-78). However, thirty to fifty percent is probably more typical.

During nursing, an infant executes a complex sequence of coordinated vacuum and mechanical tongue motions called the "suck-swallow-breathe" rhythm. During this sequence, the nipple portion of a natural teat functions in a very specific way. (See McClellan, H. L., Sakalidis, V. S., Hepworth, A. R., Hartmann, P. E. and Geddes, D. T. Validation of Teat Diameter and Tongue Movement Measurements with B-Mode Ultrasound During Breastfeeding. Ultrasound in Medicine & Biology; 2010 36 (11): 1797-1807). The steps of the suck-swallow-breathe rhythm are outlined below:

1. Initially, the tongue compresses the nipple against the roof (hard palate) of the mouth and squeezes the internal milk ducts closed, thereby shutting off milk flow. This position is known as the "fully up" position. Swallowing then ensues.
2. Just after swallowing, the tongue begins dropping from the fully up position, unclamping the nipple ducts. This action initiates the "suck" phase where an increased vacuum within the infant's mouth draws milk from the nipple into the infant's oral cavity through the ducts of the nipple. The infant stops the tongue down-motion when sufficient milk has been extracted.
3. Finally, the tongue starts back up until it is again at the fully-up position, compressing the nipple against the roof (hard palate) of the mouth, thereby squeezing the milk ducts closed, and shutting off milk flow. At this point the infant again swallows, evacuating a substantial majority of the milk in the oral cavity.

Repeated compression of the nursing mother's nipple against the infant's hard palate will cause, over time, a controlled deformation of the hard palate and thereby development of a properly-formed oral cavity with straight teeth and unrestricted sinuses. The mother's nipple enables this controlled deformation broadening of the hard palate because it is solid but deformable and allows the tongue's forces to be transmitted to the hard palate irrespective of the hard palate's shape and thereby beneficially deforming it over time. (See Palmer, B The Influence of Breastfeeding on the Development of the Oral Cavity: A Commentary: J Human Lactation: 1998: 14 (2): 93-98).

Thus, a bite-safe artificial teat having a nipple portion, formed of an elastomer, and more preferably a substantially solid elastomer, having a hardness of about Shore A 1 to about Shore A 20, and having at least one duct extending generally longitudinally from a distal end of said nipple portion to a proximal end of said nipple portion, a base portion attached at the distal end of the nipple portion and having an open interior volume contiguous with the distal end of the at least one duct, and a fiber mesh tube consisting of fibers that extend from near the proximal end of the nipple portion through the distal end of the nipple portion for attaching the nipple portion to the base portion without providing tension or compression to the nipple portion during elongation, is provided.

Further, the present invention discloses a method of modifying a cylindrical article that is constructed from a highly elastic material by adding a strong fibrous minor phase in the shape of a braided fiber mesh tube of very specific geometry, which supports any application that requires high deformability of the article, particularly radial compressibility and/or axial elongation. More particularly, in another aspect of the present invention, a method of modifying a substantially solid cylindrical article is disclosed whereby providing an elastic matrix major phase and adding a fibrous minor phase in the shape of a braided fiber mesh tube to the matrix major phase, wherein the fibrous minor phase has a higher tensile strength and elastic modulus than the matrix major phase, wherein the matrix major phase has the ability to elongate by about 5% to about 70% and has a first elasticity, wherein the fibrous minor phase has a second elasticity, the second elasticity being greater than the first elasticity, and wherein under a given applied stress, elongation of the major phase with minor phase composite is not degraded by more than about 10%.

In another aspect of the present invention a bite-safe artificial teat is disclosed, having a composite nipple portion composed of two portions wherein a first portion comprises a contiguous elastic substance, wherein a second portion comprises and helically wound fibers disposed within the elastic substance, wherein the helically wound fibers do not stretch, and wherein both portions may obtain the within 3% of the maximum stretch of the elastic substance during elongation of said composite nipple portion.

These and other objects, features and advantages of the present invention will become apparent in light of the following description of non-limiting embodiments, with references to the accompanying drawings.

DETAILED DESCRIPTION OF THE DRAWINGS

The following descriptions of the figures will convey details of construction and operation of a bite safe, artificial teat in accordance with the present invention.

Figure 1:
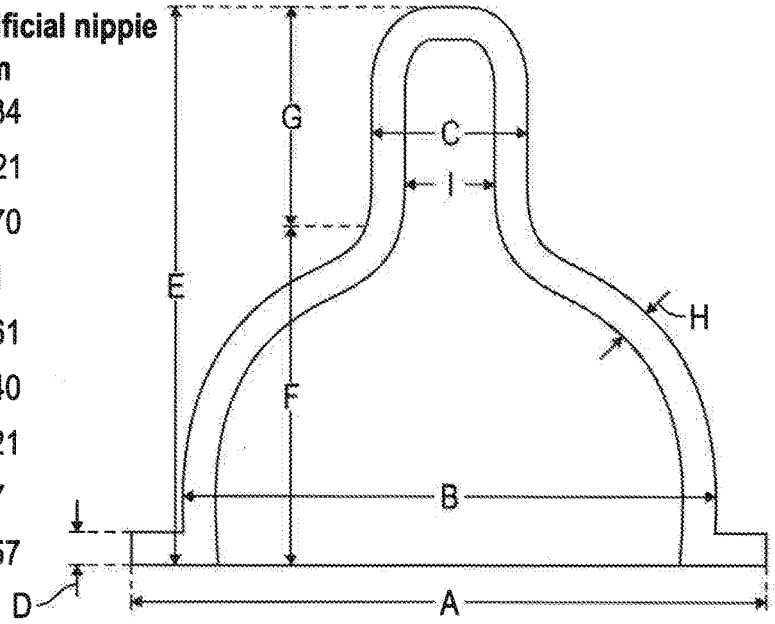
FIG. 1 is a cross sectional view of a wide-base conventional commercial artificial nipple.
Figure 2:
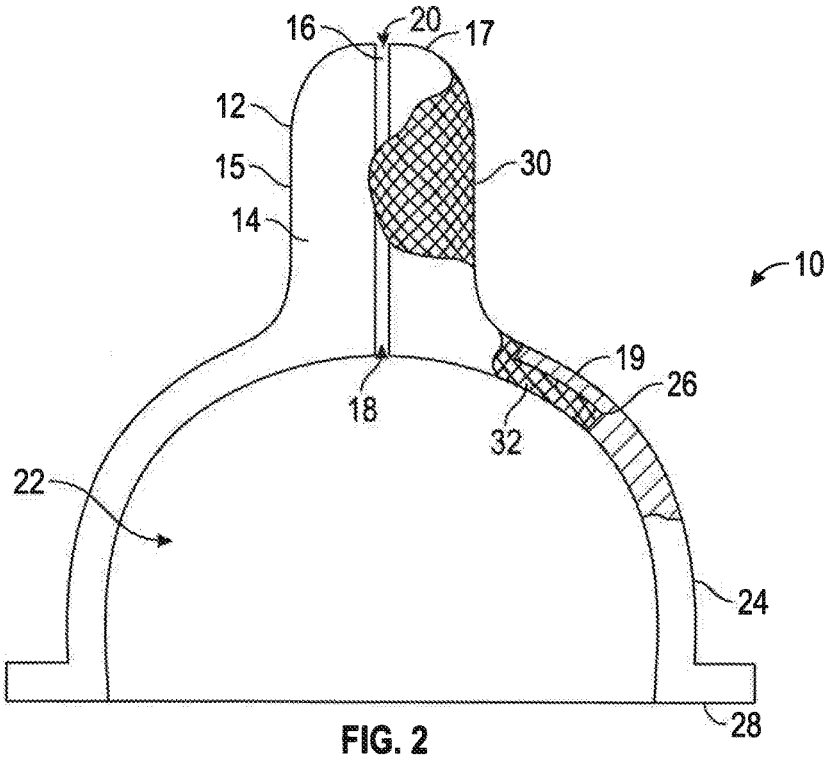
FIG. 2 is a perspective view with cross-sectional cutaways of a teat with a substantially solid and roughly cylindrical nipple portion, containing one or more central ducts and containing a braided fiber mesh tube that extends from a nipple tip somewhat into the hollow base portion.

Referring to FIG. 2, a teat 10 is formed of two sub parts: (1) at a proximal end of the teat a substantially solid nipple portion 12 for insertion into an infant's mouth; and (2) at a distal end of the teat a hollow base portion 24 for connecting the nipple portion to a feeding container, e.g., a bottle or bag (not shown). The nipple portion 12 is preferably fabricated of a very soft elastomer (e.g., silicone rubber having a hardness of Shore A 1-20, more preferably Shore A 1-10), comprising a matrix elastomer portion 14. By comparison, the base portion 24 can be fabricated with a higher hardness material than the nipple portion, e.g., silicone rubber having Shore A 20-70. Proximal and distal are used in their medical sense and directionally with respect to the nursing infant. Thus, "proximal" is closest to the nursing infant, and the proximal portion of the teat 10 and nipple portion 12 is that portion which the infant draws into its mouth. The "distal" portion of the teat 10 is that portion farthest from the nursing infant, namely, the base portion 24 which attaches the nipple portion 12 to the feeding container. The entire structure, including the two sub parts, nipple portion 12 and base portion 24, is referred to collectively as the teat 10.

In accordance with the present invention, the nipple portion 12, or small parts of it liberated by bite-through, will remain attached to the base portion 24 by a helically wound fiber mesh tube 30, typically made of high strength polymer fiber—e.g., polyethylene, polypropylene or polyester and having a significantly higher tensile strength and stiffness than the soft matrix phase. Thus, no part of the nipple portion 12 can become separated by bite-through due to the fiber mesh tube 30. The base portion 24 may also be resistant to bite-through because the safety mesh tube 30 from the nipple portion may extend somewhat into the base portion 24 through distal braided mesh fibers 32. Additionally, the base portion 24 may also be resistant to bite-through because its dome-shape is difficult for the teeth to grip and damage by biting. Moreover, the base portion 24 may be constructed of the same higher hardness silicone rubber material used to construct conventional artificial teats, which have known bite resistance.

Figures 8, 9, 10:
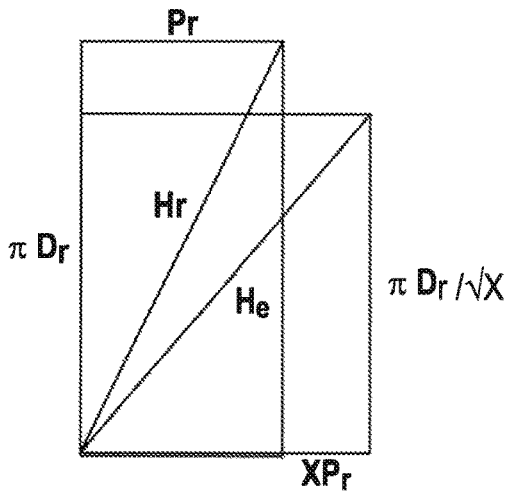
FIG. 8 shows schematically a geometric derivation of the "correct" fiber mesh tube pitch for a given tube diameter.
FIG. 9 shows, in tabular form, the calculated "correct" pitch values for fiber mesh tubes of different diameter.
FIG. 10 shows, in tabular form, experimental elongation results of samples having different pitch values for the fiber mesh tube and the calculated stretch at 50% elongation for each sample.
Figure 11:
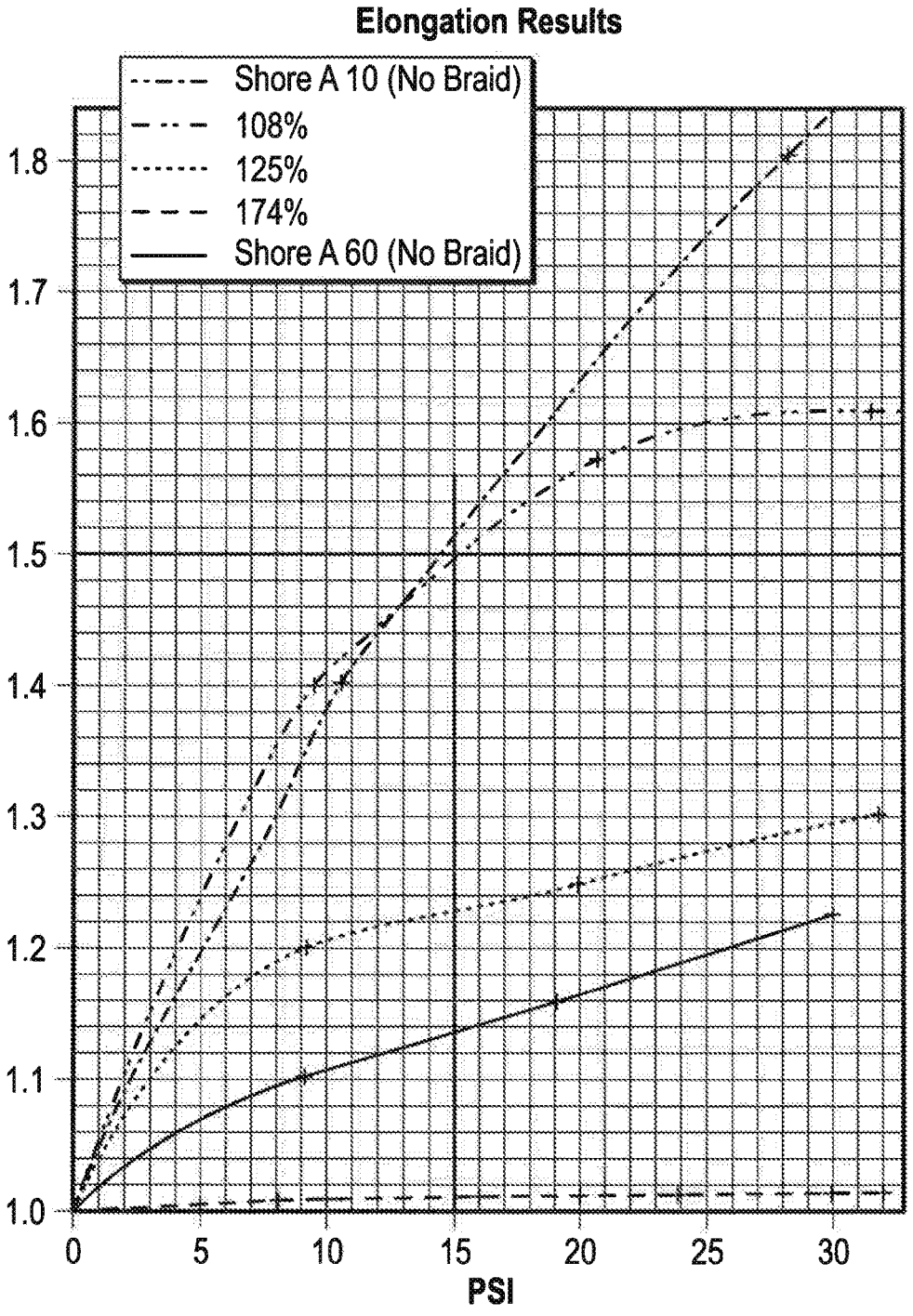
FIG. 11 shows a graphical representation of the experimental elongation results of samples having different pitch values for the fiber mesh tube.

As seen in FIGS. 10 and 11, the fiber mesh tube 30 with the "correct" geometry, surprisingly, does not significantly degrade the desirable softness and elasticity of the nipple portion 12.

The nipple portion 12 is further described in detail with reference to FIGS. 2 and 3.

Nipple Portion Exterior Shape.

Referring to FIG. 2, the outer side surface 15 of the nipple portion 12 can be roughly cylindrical in shape. Alternate shapes of the nipple portion 12 may also be used without departing from the spirit and principles of the present invention, and as such, though the present invention is generally described with reference to an artificial teat for feeding a baby, the present invention can also be used with other nipple-related applications, such as sippy cups, pacifiers, animal feeding, and Continuous Positive Airway Pressure ("CPAP") components.

The extreme proximal (terminal) end 17 of the teat portion 10 has smooth contours, shaped to present no sharp-edged features that would irritate the infant. The proximal end 17 may be configured in any number of ways, for example, it might be a section of a sphere, a hemisphere, and it may also contain flat areas on the very end where the duct(s) 16 exits the structure.

Figure 3:
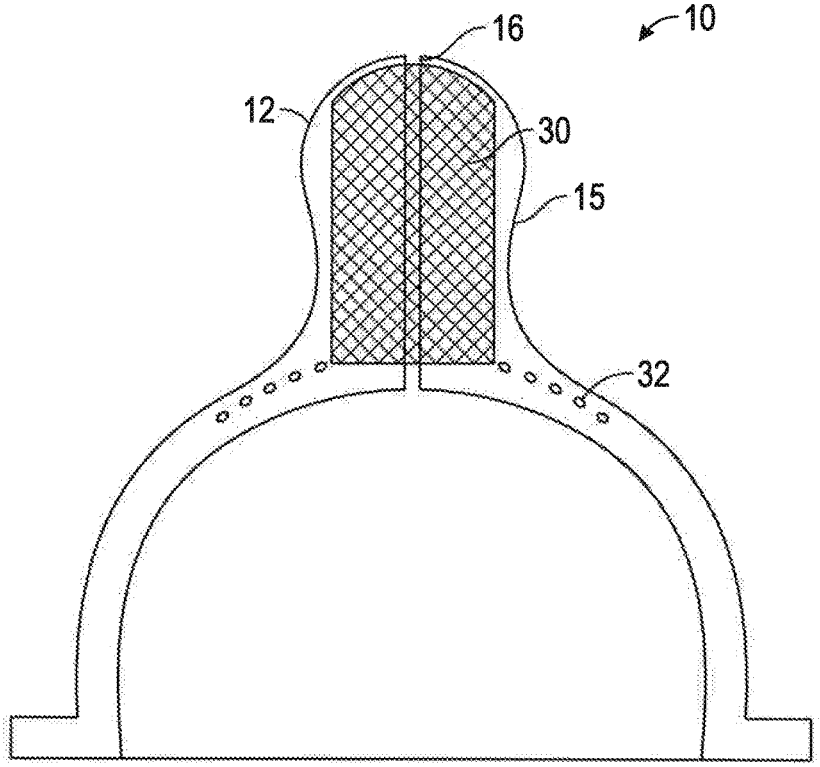
FIG. 3 is a cross sectional view of a teat with a contoured nipple.

Referring to FIG. 3, the exterior shape of the nipple portion of the teat may be contoured, while the mesh tube 30 disposed therein may be a cylinder with elastomer outside the outer surface 15 and thicker in some sections than in others.

Nipple Portion Internal Structure.

Referring to FIG. 2, the nipple portion 12 is a "substantially solid" body. For the purpose of the present invention "substantially solid" is taken to mean that the matrix elastomer portion 14 fills more than about seventy-five volume percent of the nipple portion 12. Running through the nipple portion 12 are at least one or a plurality of ducts 16 oriented in a roughly axial direction extending longitudinally from the distal portion of the nipple to the proximal portion of the nipple. Milk flows from a feeding container through the hollow interior 22 of the base portion 24 into an opening 18 then through the duct(s) 16 and into the infant's mouth, when the infant applies vacuum in accordance with the "suck-swallow-breath" rhythm.

Multiple openings 18 corresponding to multiple ducts 16 may also be used without departing from the spirit and principles of the present invention.

The duct(s) 16 may be round in cross section, with a diameter about 2 mm, but can be larger or smaller, or have other cross-sectional shapes, for example, an oval cross section or the like. The infant may position these oval ducts 16 in its mouth so that the long axis of the oval cross-section is sideways in the mouth and so compression occurs across the short axis of the ducts 16 is facilitated. Additionally, the outer cross section of the nipple portion 12 may also not be round, but oval, keyed rotationally to oval internal duct(s) 16.

Figure 7:
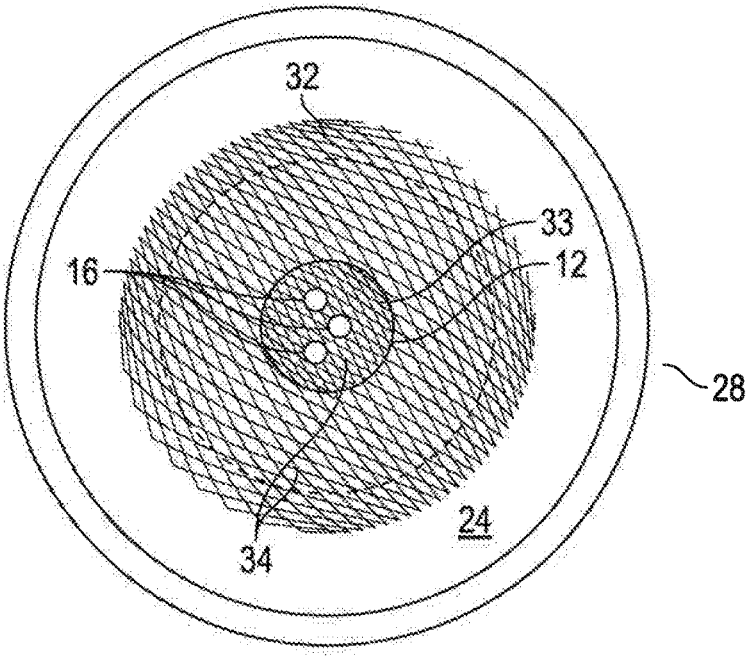
FIG. 7 shows a top view of a teat illustrating the braided fibers crossing over at a nipple tip section of the nipple portion and partially extending from the nipple portion into the base portion.

Referring to FIG. 7, viewed axially from the tip of the nipple portion 12, ducts 16 can be arranged in any of a variety of patterns: concentric circles, triangle, cross-shaped, "Y" shaped, etc.

Nipple Proximal End Configurations.

Referring to FIG. 2, position 20 (i.e., the extreme proximal end of the duct 16) may have a variety of terminal configurations, some of which may act as a secondary shutoff valve.

The terminal configuration of each duct 16 may be an open orifice with a diameter consistent with that of the duct 16. With such an end configuration, milk is free to flow from a feeding bottle through the duct 16 whenever the infant applies a vacuum and the nipple portion 12 is not compressed such that the duct 16 is squeezed shut. This configuration would act as a primary rather than a secondary shut off valve.

Still referring to FIG. 2, the outer opening at position 20, where the duct 16 exits the proximal end of the nipple 12, may have a normally-closed secondary valve to assist in shutting off fluid flow when vacuum falls below a certain value. In this case, a thin (typically less than about 2 mm) membrane of the same soft elastomer that is used to construct the nipple portion 12 completely covers, and thus closes, the proximal end of the duct 16. This membrane may be slit through with a single cut thereby forming a "slit-valve" similar to those used in "bite valves" for example as described in U.S. Pat. No. 5,085,349 to Fawcett, but, in accordance with the present invention, actuated by vacuum. Alternatively, there could be multiple cuts, e.g., forming an "X", a cross or a "Y" pattern. Openings of the membrane-plus-slit configuration are expected to dilate with increased vacuum and thus flow would be expected to increase non-linearly with increasing vacuum.

As discussed above, the secondary shutoff is positioned at the extreme proximal tip 17 of the nipple 12, position 20. However, such a shut-off could be positioned anywhere along the duct 16 without departing from the spirit and principles of the present invention.

At the extreme distal end of the nipple portion 12, the substantially solid matrix elastomer portion 14 ends and the duct 16 has an opening 18 into the hollow interior 22 of the base portion 24.

Nipple Portion—Safety Mesh.

Figure 4:
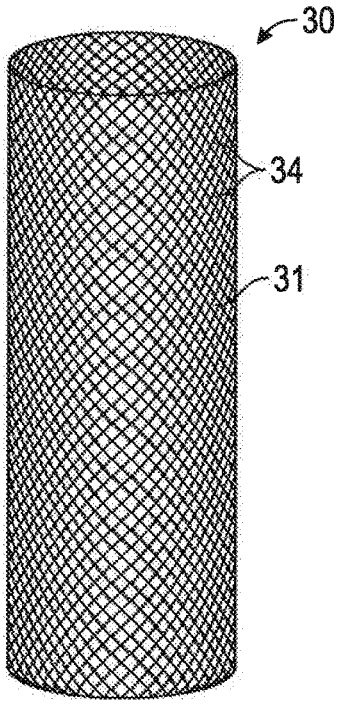
FIG. 4 is a perspective view of a braided fiber mesh tube as embedded in the teats of FIGS. 2, 3 and 5-7.

Referring to FIG. 4, embedded in the matrix elastomer portion 14 of the nipple portion 12 is a roughly cylindrical tube of braided fiber mesh 30. This mesh tube 30 can be molded-in near the outer surface 15 of the nipple portion 12 such that it lies entirely below the surface, but otherwise is disposed close to the outer surface. The mesh tube 30 may also be molded near the duct 16 in alternate embodiments.

When positioned near the outer surface 15 of the matrix elastomer portion 14, the mesh tube 30 acts also as a "safety fence" or "bite fence" to resist biting forces from an infant's teeth, which could tear the nipple portion without the presence of the mesh tube 30. In the case of biting damage sufficient to sever the soft matrix elastomer inside the fiber mesh tube 30, a bitten nipple piece would remain attached to the teat base 24 by way of the mesh tube 30, thereby eliminating any danger of the bitten piece becoming a choking hazard. Thus, the mesh tube 30 mechanically maintains connection between the otherwise separated choking hazard nipple portion 12 and the base portion 24.

Referring to FIGS. 2-7, the mesh tube 30 is preferably fabricated of braided fibers 31 helically wound in opposite directions thus forming a braided tubular shape and having crossover points 34. One advantage of the present invention as an attachment device is that during molding of the nipple, the soft elastomer will fill the interstitial diamond spaces between the braided mesh fibers 31 and thus the mesh tube 30 will be firmly attached to the matrix elastomer portion 14, thereby offering excellent pullout resistance while providing the needed mechanical connection and bridging along the nipple portion 12. Pullout resistance could be further improved by utilizing multi-filament fibers ("yarn") in which, during molding the soft elastomer would be expected to percolate between the yarn strands. Moreover, cut resistance tends to be better for yarns than monofilament fibers. In this regard, some fibrous materials have better cut resistance than others, e.g., ultrahigh molecular weight polyethylene is better than polyester.

Figure 6:
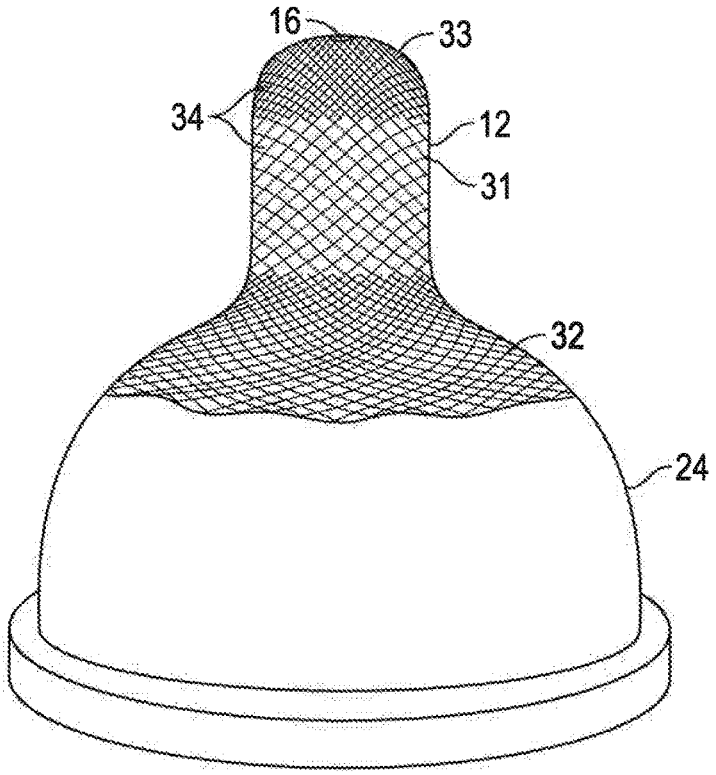
FIG. 6 shows a side view of a teat where the braided fiber mesh tube crosses the tip of the nipple, continues on the outside of the nipple, and partially extends into the base portion.

The crossover points 34, best illustrated in FIGS. 6 and 7, may be free-sliding, or they may be bonded or some portions of the mesh tube 30 may have bonded crossover points while other portions remain free-sliding. Bonding of the braided mesh tube crossover points 34 is expected to give some measure of rigidity to the braided fiber mesh tube 30 and thereby greatly facilitate manufacturing handling, proper placement (e.g., over a mandrel in the mold cavity) and maintenance of integrity and fiber geometry during insertion injection molding. On the other hand, free-sliding crossover points 34 are likely to better facilitate deformation of the matrix elastomer portion 14.

The mesh tube 30 extends axially along substantially the whole nipple portion 12. It may also extend somewhat into the base portion (as illustrated by distal fibers 32 shown in FIGS. 2, 3, and 5-7) to improve bite-resistance of that region and also to maintain connection between the nipple portion 12 of the teat 10 and the base portion 24. In this latter case, the distal fibers 32 that extend into the (non-cylindrical) base portion may have the crossover points 34 free-sliding, allowing the mesh to accommodate contours larger than the relaxed diameter of the fiber mesh tube 30.

Nipple Portion—Calculation of Safety Mesh Geometry.

Generally, a helically braided fiber tube imbedded in the near surface of a solid right cylinder or tube of polymeric material would be expected to strengthen the structure and as a consequence increase its stiffness and limit its ability to deform (in elongation, radial compression or radial expansion). See, for example, U.S. Pat. No. 5,630,802 to Inagaki et al., which utilizes a wrapped fiber layer to reinforce medical tubing. However, as noted in connection with the "suck-swallow-breathe" rhythm, it is desirous for optimal operation of an artificial teat to have the nipple portion of the teat easily compress and elongate within an infant's oral cavity in response to the infant's sucking/swallowing as well as the mechanical movement of the infant's tongue.

The mechanical behavior of the present invention does not have such stiffening which would restrict compression and/or elongation of the nipple. In use, axial or radial mechanical deformations of 50% or more are expected and desired. Therefore, the braided fiber mesh tube 30 must be added in such a way that deformability of the nipple is preserved, i.e., desirable matrix softness and elasticity must not be degraded. This is accomplished by providing the fiber mesh tube 30 in such a configuration so that, as the nipple freely deforms by action of the suckling infant, the fibers track the deformation without developing significant tension or compression during elongation of the nipple portion, and so do not exert a deleterious stiffening effect. Thus, the desired matrix properties are preserved and the desired performance of the nipple is also preserved so that it can mimic properties and function of a natural teat during feeding. As a result, the braided fiber mesh tube 30 of the present invention provides safety, but safety without mechanical reinforcement.

Referring to FIG. 2, the nipple portion 12 has a roughly cylindrical exterior shape with the braided safety mesh tube 30 positioned near to the exterior surface 15. Thus, the mesh tube 30 will be molded into the matrix elastomer portion 14 at a specific diameter with "substantially solid" soft, elastic polymeric material occupying the space (the "core") inside the mesh tube.

Referring to FIG. 4, the individual fibers 31 of the mesh will trace helical paths around this "core". One set of fibers spirals in one direction, the other set spirals in the opposite direction describing a diamond-pattern mesh. There can be multiple fibers equally spaced around the circumference of the tube. If the individual fibers of the tube were screw threads these multiple fibers would be termed a "multi-lead" screw. At the cross over points 34 the fibers 31 may be "bonded" together or not bonded.

Referring to FIG. 6, the fibers 31 of the mesh tube 30 may extend proximally crossing over the nipple tip section, but not interfering with the duct 16. To improve bonding of the proximal fibers 33 of the nipple tip to the matrix elastomer portion 14, crossover points 34 in the nipple tip region may, preferably, be bonded. The proximal fibers 33 of the nipple portion 12 may, preferably, be free sliding. The fibers 31 may also extend distally into the base portion 24. The distal fibers 32 extending into the base portion 24 may, preferably, be bonded.

Referring to FIG. 7, the proximal fibers 33 of the mesh tube 30 may more frequently cross over at the nipple tip section of the nipple portion 12, surrounding the ducts 16. As the fibers 31 extend distally into the base portion 24, the distal fibers 33 may splay out and thus have less crossover points 34.

Referring to FIG. 8, the fibers 31 and the braided mesh tube 30 they form can be described by the following geometric parameters:

$D_r$=Relaxed diameter=diameter of the mesh tube when the teat is relaxed, not elongated.

$D_e$=Elongated diameter=diameter of the mesh tube when the teat is elongated, generally up to a fractional elongation of 1.5 times the relaxed length. $D_e$ will always be less than $D_r$.

$P_r$=pitch of the fiber when the core is relaxed=the distance along the (relaxed) length needed for each fiber to make one complete wrap.

$P_e$=(calculated) pitch of the fiber when the core is elongated by a factor of X, $P_e$=the distance along the (elongated) length needed for each fiber to make one complete wrap. $P_e=XP_r$.

X=the fractional length elongation. For example if $P_r$=1.0 and $P_e$=1.5, then X=1.5.

$H_r$=relaxed hypotenuse length=length of an individual fiber having made one complete wrap when the "core" is relaxed.

$H_e$=elongated hypotenuse length=(calculated) length of an individual fiber having made one complete wrap when the "core" is elongated.

Calculations for Mesh Tube Geometry.

It is assumed that volume of the soft, elastic polymeric material occupying the entire volume of the "core" (a right cylinder) inside the mesh tube 30 is the same when it is relaxed and when it is extended (conservation of volume principle). Therefore, if the nipple portion 12 of the artificial teat 10 is modeled as a solid right cylinder and if the length of that cylinder is extended by 50% (i.e. X=1.5) and assuming no change in volume of the elastomer 14, then the diameter will decrease to about 82% of its original value.

The individual fibers 31 could be thin, for example about 0.004 to about 0.01 inches in diameter, more preferably about 0.006 inches in diameter to be flexible, but also strong, for example between about 5-25 lb. breaking strength, more preferably about 15 lb. breaking strength.

The individual fibers 31 will trace helical paths around the right cylinder of the "core". Referring to FIG. 8, if the surface of the relaxed "core" is "unrolled", an individual fiber will lie on the hypotenuse of a triangle where one side is the circumference of the right cylinder of the "core" ($=\pi D_r$) and the other leg=$P_r$.

From the Pythagorean theorem, $(H_r)^2=(\pi D_r)^2+(P_r)^2$.

When the "core" is extended by a factor, X, the new pitch of the fiber will be $P_e=XP_r$ and the diameter will reduce from $D_r$ to $D_e$. Assuming conservation of volume, $D_e=D_r/\sqrt{X}$. Now, the individual fibers will trace a different helical path around the right cylinder of the extended "core". If the surface of this extended "core" is "unrolled", an individual fiber will lie on the hypotenuse of a triangle where one side is the circumference of the (smaller) right cylinder of the "core" ($=\pi D_e=\pi D_r/\sqrt{X}$) and the other leg is the new pitch of the fiber=$P_e=XP_r$.

From the Pythagorean theorem $(H_e)^2=(\pi D_r/\sqrt{X})^2+(XP_r)^2$. (See FIG. 8).

In order for the fiber 31 not to change the desired properties of the soft, matrix elastomer portion 14 the fiber 31 must not appreciably change its length i.e., experience significant tension or compression when the nipple portion 12 is elongated. Mathematically, this means the hypotenuse of the fiber 31 when imbedded in the relaxed core (described above) and the hypotenuse of the fiber 31 when imbedded in the core elongated by X (described above) must have the same length.

Having the same length means the relaxed hypotenuse must equal the elongated hypotenuse:

$$(H_r)^2=(H_e)^2 \text{ and so: } (\pi D_r)^2+(P_r)^2=(\pi D_r/\sqrt{X})^2+(XP_r)^2$$

$$\text{So: } P_r=\sqrt{((\pi D_r)^2-(\pi D_r/\sqrt{X})^2)/(X^2-1))}$$

$$\text{Or: } P_r=\pi D_r\sqrt{((1-1/X)/((X^2-1))}$$

For every nipple diameter there will be an effective diameter of the (relaxed) mesh tube ($D_r$). Assuming an elongation of 50% (i.e. X=1.5) there will be an ideal pitch length ($P_r$) for the fibers that allows them to experience neither tension nor compression when the teat is elongated by 50% (i.e. X=1.5). For the case of X=1.5; $P_r$=1.62 $D_r$.

For X=1.5 and various $D_r$ values, the $P_r$ values that meet this requirement are provided in FIG. 9.

Nipple Portion—Definition of the Preferred Range of Safety Mesh Geometry.

Experimental Results

Referring to FIG. 10, cylindrical samples of silicone rubber having Shore A hardness of 10 or 60 with or without helically wound braided fiber tubes imbedded in the near surface were prepared. Each sample had a specific $D_r$ (diameter of the mesh tube when the cylinder is relaxed, not elongated) and $P_r$ (pitch of the fiber when the core is relaxed). Samples were progressively weighted to elongate them, if possible, up to 150%. Considering the reduced cross sectional area, the applied stress was calculated for each weight and the percentage elongation noted.

FIG. 11 plots results described in FIG. 10. Stress vs. elongation behavior for the silicone rubber Shore A 10 material with no fiber was the benchmark for "desirable" performance. Stress vs. elongation behavior for the silicone rubber Shore A 60 material with no fiber was the benchmark for "undesirable" performance.

A first sample cylinder was prepared of silicone rubber having Shore A 10 hardness and no fiber mesh tube. Its elongation was measured under increasing applied stress. A second sample cylinder was prepared of silicone having Shore A 10 hardness with fiber mesh tube imbedded having 108% of the "correct" pitch for the diameter of the sample cylinder.

As shown in FIGS. 10 and 11, under 15 psi applied stress the second sample cylinder elongated to X=1.5, substantially the same as the first sample cylinder having no fiber mesh. Using the methodology described in FIG. 8 and above, the calculated stretch for fibers in the second sample cylinder at an elongation of X=1.5, was 2%. A third sample cylinder was prepared of silicone rubber having Shore A 10 hardness with fiber mesh tube imbedded having 125% of the "correct" pitch. As noted, the third sample cylinder at 15 psi applied stress elongated only to X=1.22. The calculated stretch for fibers in the third sample cylinder if it had been able to elongate to X=1.5 would have been 6%. A fourth sample cylinder was prepared of silicone rubber having Shore A 10 hardness with fiber mesh tube imbedded having 174% of the "correct" pitch. This fourth sample cylinder barely elongated under 15 psi applied stress. By comparison, a fifth sample of silicone rubber Shore A 60 polymer having no fiber mesh elongated further than the fourth sample cylinder, but less than the third.

The results above and data presented in FIGS. 10 and 11 demonstrate that under 15 psi applied stress and for elongations up to X=1.5, a sample with fiber mesh tubes having 108% of the "correct pitch" and experiencing a (calculated) fiber stretch of 2% does not appreciably degrade stress vs. elongation properties in comparison to a silicone rubber Shore A 10 sample having no fiber mesh. Under the same loading conditions however, a sample with a fiber mesh tube having 125% of the "correct pitch" and experiencing a (calculated) fiber stretch of 6%, demonstrated stress vs. elongation properties better than the Shore A 60 sample having no fiber mesh, but considerably worse than the Shore A 10 sample having no fiber mesh. Accordingly, the data demonstrates that addition of a fiber mesh tube having 108% of the correct pitch and 2% fiber stretch is acceptable whereas addition of fiber mesh tubes having 125% of the correct pitch and 6% fiber stretch is not acceptable. Although not shown experimentally, the data allows for extrapolation that up to 3% fiber stretch corresponding to 115% of the "correct" pitch would be acceptable. Accordingly, the same range may hold true in the case of fiber compression.

Based on the extensive testing and notation of acceptable and unacceptable results, the preferred range is ±15% of "correct" fiber pitch Pr where $Pr=\pi D_r\sqrt{((1-1/X)/((X^2-1))}$.

Nipple Portion—Materials of Construction.

The "substantially solid" portion of the nipple 12 is constructed of a soft elastomer with properties that mimic properties of a mother's nipple. For example, it may have a Shore A hardness of about 1 to about 20. The nipple portion 12 may be made of any suitably soft and elastic food-grade material, for example silicone rubber, although other soft polymeric materials such as thermoplastic elastomer (TPE) or latex are also possible. Addition of minor phases to the "substantially solid" portion of the nipple may be included to beneficially modify properties of the bulk material, for example closed voids might be added to increase softness and elasticity.

Nipple Portion—Operation.

The soft, elastic nipple portion 12 of the artificial teat 10 has properties and function that mimic the nursing mother's nipple, namely it is:

1. Highly elastic—to allow elongation until the nipple tip with duct openings 20 is properly positioned at the downward curve of the hard palate at the rear of the infant's mouth.

2. Soft and compressible—to allow the upward force of the infant's tongue to compress and deform the nipple 12 against the (hard palate) roof of the mouth squeezing closed the duct(s) 16 and thereby shutting off fluid flow during swallowing. The duct(s) 16 may also include secondary shut-off valves, located at the nipple tip position 20, which restrict or prevent milk flow below a minimum vacuum level. The secondary valves may act with duct clamping to shut off, or restrict, fluid flow during swallowing when the tongue is compressing the nipple and/or vacuum is at its lowest.

3. Material and structure which is solid but deformable—allowing the tongue's forces to be transmitted to the hard palate irrespective of the hard palate's shape and thereby beneficially deforming the hard palate over time, facilitating development of a properly-formed hard palate and oral cavity with straight teeth and unrestricted sinuses.

To make this substantially solid soft, elastic nipple portion 12 safe against bite-through and the potential of a resulting choking hazard, the fiber mesh tube 30 is incorporated as taught by the present invention. Referring to FIG. 4, the fiber mesh tube 30 has a specific configuration which allows it to NOT act as a "reinforcing member" and so it does not stiffen the structure which would destroy the desired deformability of the matrix elastomer portion 14.

Base Portion—Exterior Shape and Internal Structure.

Referring to FIG. 2, the second sub part of the teat 10 is the base portion 24 disposed at the distal end. The base portion 24 is attached to the nipple portion 12 and at the extreme distal end is designed to attach to the feeding container in a fluid-tight manner.

The base portion 24 has a hollow interior 22 so that during feeding, breast milk or artificial "formula" from the feeding container can flow into the opening(s) 18 at the distal end of the nipple portion 12. The base portion 24 typically has a wall thickness similar to that of a conventional artificial teat namely about 0.04 inch (1.0 mm), although it can be thicker. From the inflection point of the outer surface 15 at the distal end of the nipple portion 12, the base portion 24 flares out, mimicking the dome of the mother's breast. The base portion 24 terminates at a distal flange 28, used for sealing the teat to a feeding container 42, such as a bottle via a threaded connection collar 40 such as illustrated in FIG. 5.

Figure 5:
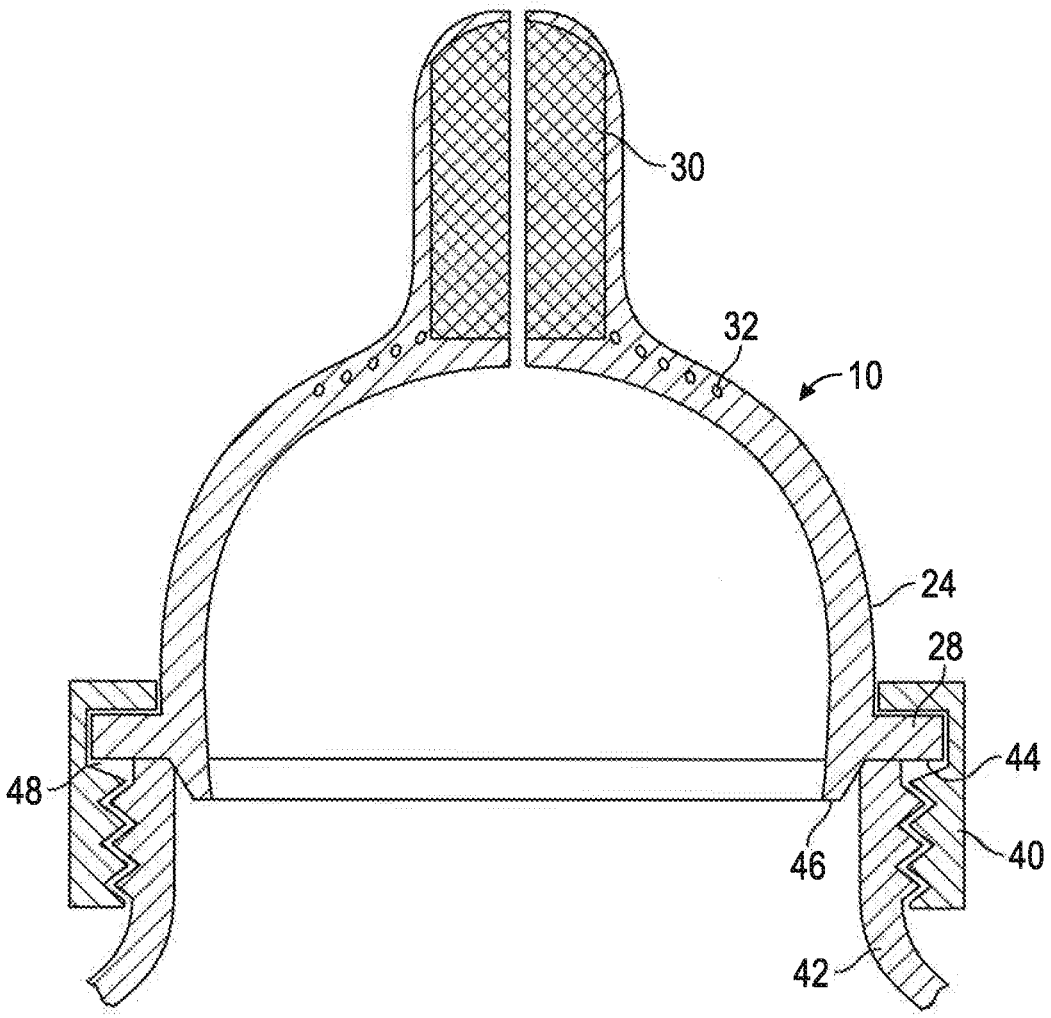
FIG. 5 is a cross sectional view of a teat assembled with a collar that attaches the teat to a bottle.

Referring to FIG. 5, the base portion 24 can be connected by threaded collar 40 to a feeding container 42. The collar 40 may be co-molded as an integral part of the teat 10, or may be a separate ring. Collar/ring 40 is typically constructed from a hard plastic with a sufficiently high elastic modulus that with tightening it does not deform and compromise attachment or sealing between the teat 10 and the feeding container 42.

Still referring to FIG. 5, the distal flange 28 of the base portion 24 can be sealed onto the proximal surface of the feeding container using a compression seal 44 (and optionally, a lip seal 46) or other means to prevent leakage of fluid between the teat 10 and the feeding container 42.

A vent 48 may also be provided, for example at the compression seal 44, for air to enter the bottle as fluid is removed by the infant, thereby preventing vacuum buildup inside the bottle. Such a vent 48 may be a groove cut radially across the distal surface of the compression seal 44, which with tightening, remains sufficiently open to allow air to enter through the threads of the collar 40, through the vent, then into the container 42, without being such a large opening that fluid leaks out.

The vent 48 may also be a small duck bill valve molded into the base portion 24 of the teat 10, configured so that air can enter the bottle through the valve, but fluid cannot leak out.

Another type of seal pictured in FIG. 5, is a lip seal 46 comprising a conical ring molded onto the extreme distal surface of the base portion 24. The diameter of this conical lip seal 46 is slightly larger than the inside diameter of the feeding container neck, so that when the teat 10 is tightened onto the feeding container 42 with the integral collar or separate ring 40 then the conical lip seal 46 is forced into the neck of the container 42 making a seal between the inside top surface of the container and the conical lip seal 46.

Base Portion—Materials of Construction.

Referring to FIG. 6, the base portion 24 may be constructed of the same soft, matrix elastomer portion 14 material that is used to construct the nipple portion 12. This construction should afford sufficient bite-resistance because the dome shape will be difficult for the infant's teeth to grip during bite attempts. Bite-resistance in the transition zone between nipple and base portion may be further enhanced by extending the individual fibers 31 somewhat into the upper sidewall of the base portion 24. In this case, to enable the fiber mesh 30 to accommodate the ever-increasing diameter of the dome-shaped base portion 24, it may be necessary for the fiber mesh in this zone to not have bonded crossover points 34.

In another embodiment shown in FIG. 2, the bite-safe construction for the base portion 24 uses the same material typically used to fabricate conventional artificial teats, i.e., silicone rubber having a Shore A hardness in the range 50 to 70. The advantage of using a higher hardness material for the base portion is resistance to bite-through and minimizing choking hazards. A disadvantage is that this design requires injection of another material, increasing mold and manufacturing costs.

Base Portion—Attachment to Nipple Portion.

As noted above, the base portion 24 may be constructed of the same material as the nipple portion 12. In such a situation, the two portions can be molded as one single unit and there will be no attachment between the two portions.

In another embodiment, however, the nipple portion 12 may be molded from soft, elastic material with Shore A hardness between about 1 and about 20 and the base portion 24 may be molded from harder material with a Shore A hardness between, for example, 50 and 70. Then the two parts must be joined to provide firm attachment between the two sub portions and designed so there is no loss of bite-through resistance afforded by the mesh tube 30 from the nipple tip fibers 33 through the reinforced nipple portion 12 and into the base portion 24 with distal fibers 32. In this case both sub-parts may be joined permanently with a half lap splice joint 26, also referred to as a scarf joint 26 as illustrated in FIG. 2. This joint 26 can be formed by two-shot molding, adhesive or chemical bonding, ultrasonic welding or any other suitable method to achieve a durable, leak-tight bond between both sub-parts. The higher hardness material may form the outside portion 19 of the half lap splice joint 26 as pictured in FIG. 2 or it may form the inside portion of the half lap splice joint.

Artificial Teat—Operation.

As described herein, the two sub portions nipple portion 12 and base portion 24 of the teat 10 are both designed to be resistant to bite-through and thus safe against possible choking hazard. The nipple portion 12 achieves this result because of the braided fiber mesh attachment scheme. The base portion 24 achieves this result because its large, hollow dome shape makes it hard to grip and inflict biting damage. Moreover, the safety mesh tube 30 may extend from the extreme proximal end of the nipple portion 12 partially into the base portion 24. Alternatively and in addition, the base portion 24 may be constructed of higher hardness elastomers as typically used in conventional artificial teats, which is naturally resistant to bite-through and is thus safe against possible choking hazard.

In operation, the cross-sectional size and shape of the duct 16 in conjunction with the soft elastomer of which the substantially solid nipple portion is constructed, act under the compressive forces exerted by the infant's tongue when it is in the "full up" position, the ducts 16 can be squeezed shut, thereby preventing continued, unwanted, fluid flow. This shut-off facilitates swallowing by the infant without being flooded. Compressive shut-off of the duct 16 is an advantage over other artificial nipples which are both too hard and have too large an interior volume to be closed off by compression.

In operation, an advantageous aspect of the present invention is to enable the design and construction of a safe, extremely soft and flexible artificial teat, which more closely replicates function and performance of the mother's breast and teat in the mouth of a suckling infant. This will allow the infant's suck-swallow-breathe rhythm used with the artificial teat to be the same as that used with breast-feeding.

Bringing the two rhythms into concurrence avoids a major problem of most artificial teats, namely to cope with the different functioning of conventional artificial teats, the infant must develop a different suck-swallow-breathe rhythm than that used in breast-feeding.

A difference between breast feeding and conventional breast milk bottle-feeding with an artificial teat is that it is easier to extract milk from an artificial teat and infants can become "lazy nursers". These differences cause a condition termed "nipple confusion". Because of these differences, an infant that uses a conventional artificial teat may be unable or unwilling to return to breast-feeding after bottle-feeding and so the infant may reject the breast. Any prolonged absence from nursing may result a mother's milk supply drying up. This is a highly undesirable outcome for a mother alternating between breast-feeding and breast-milk bottle-feeding and intent on continuing to feed breast milk to her infant.

While the present invention addresses feeding breast milk to an infant, the artificial teat described in the present invention may also be used to feed "formula" either as a supplement to the mother's own breast milk or as the infant's exclusive food source.

Although described for feeding of human infants, the present invention could be used also for feeding of other animals. Teachings of this invention may also be used for non-feeding devices such as infant pacifiers, which benefit from soft, elastic polymeric materials that are subject to biting damage and so need to be safe from choking hazards.

An advantageous aspect of the present invention is that the braided fibrous mesh tube 30, introduced in a very specific configuration, experiences neither significant tension nor compression as the teat is compressed and/or elongated in use, and so does not act to "reinforce" the soft, elastic matrix phase, which would inhibit desired operation of the nipple portion 12. Thus, the specific configuration of the braided fibrous mesh tube avoids creating a classic load-transfer composite, which would degrade the soft, elastic properties of the matrix phase that are needed for the desired functioning of the artificial teat.

Additionally, teachings of this invention may also be used for Continuous Positive Airway Pressure ("CPAP") machines. Specifically, the above described "bite fence" may prevent choking hazards and separation of the breathing apparatus used to treat infants or adults who have respiratory distress syndrome, bronchopulmonary dysplasia, sleep apnea and the like.

Although this invention has been shown and described with respect to the detailed embodiments thereof, it will be understood by those skilled in the art that various changes in form and detail thereof may be made without departing from the spirit and scope of the invention.

Additionally, it is also to be understood that the terminology used is for the purpose of describing particular embodiments only, and is not intended to limit the scope of the claims of the present invention.

What is claimed is:

1. A bite-safe artificial teat comprising:

a nipple portion, formed of an elastomer having a hardness of about Shore A 1 to about Shore A 20, and having at least one duct extending generally longitudinally from a distal end of said nipple portion to a proximal end of said nipple portion;

a base portion attached at the distal end of the nipple portion and having an open interior volume contiguous with the distal end of the at least one duct; and a fiber mesh tube consisting of fibers that extend from the proximal end of the nipple portion through the distal end of the nipple portion for attaching the nipple portion to the base portion without providing tension or compression to the nipple portion during elongation;

wherein the fibers of the fiber mesh tube are arranged at a pitch $P_r$ that is determined according to $P_r=\pi D_r\sqrt{((1-1/X)/((X^2-1))}$ in which $P_r$ is the axial length required for one complete fiber wrap, $D_r$ is the relaxed diameter of the fiber mesh tube and X is the fractional elongation.

2. The artificial teat of claim 1 wherein the base portion has a hardness of about Shore A 20 to about Shore A 70.

3. The artificial teat of claim 2 wherein the base portion comprises a material selected from the group consisting of silicone rubber, thermoplastic elastomer (TPE), and latex.

4. The artificial teat of claim 1 wherein the nipple portion comprises a material selected from the group consisting of silicone rubber, thermoplastic elastomer (TPE), and latex.

5. The artificial teat of claim 1 wherein the fibers of the fiber mesh tube comprise a material selected from the group consisting of polyethylene, polypropylene and polyester.

6. The artificial teat of claim 1 wherein the base portion is attached to the nipple portion by a half-lap splice joint.

7. The artificial teat of claim 1 wherein the at least one duct has a round or oval cross section.

8. The artificial teat of claim 1 wherein the at least one duct comprises a plurality of ducts are arranged in a pattern selected from the group consisting of a "Y" shape, triangle shape or concentric circles shape.

9. The artificial teat of claim 1 wherein the fiber mesh tube is a braid comprising helically wound fibers at about ±15% of the pitch $P_r$ for a specific diameter.

10. The artificial teat of claim 1 wherein the fibers of the fiber mesh tube are about 0.004 to about 0.01 inches in diameter and are between about 5 lb. to about 25 lb. breaking strength.

11. The artificial teat of claim 10 wherein the fibers of the fiber mesh tube are about 0.006 inches in diameter and about 15 lb. breaking strength.

12. The artificial teat of claim 1 further comprising;

a threaded collar;

a feeding container; and a vent;

wherein the threaded collar connects the feeding container to the base portion, creating a compression seal, and wherein the vent is configured to allow air to enter the feeding container as fluid is removed through the at least one duct by an infant.

13. The artificial teat of claim 12 wherein the vent is a duck bill valve molded into the base portion, configured to allow air to enter the feeding container, but not allow fluid to leak out through the vent.

14. The artificial teat of claim 1 further comprising;

a conical ring molded onto the distal surface of the base portion; and a feeding container;

wherein the diameter of the conical ring is slightly larger than the inside diameter of the feeding container to create a lip seal when connected to the feeding container.

15. The artificial teat of claim 1 further comprising;

a secondary shut off valve;

wherein the secondary shut off valve covers the at least one duct at the proximal end of the nipple portion.

16. The artificial teat of claim 1 wherein in the fibers of the fiber mesh tube form a diamond-pattern mesh.

17. A bite-safe artificial teat having:

a composite nipple portion composed of two portions;

wherein a first portion comprises a contiguous elastic substance;

wherein a second portion comprises helically wound fibers disposed within the elastic substance;

wherein the helically wound fibers do not stretch;

wherein both portions may obtain within 3% of the maximum stretch of said elastic substance during elongation of said nipple portion; and wherein the fibers of the fiber mesh tube are arranged at a pitch Pr that is determined according to $P_r=\pi D_r\sqrt{((1-1/X)/((X^2-1))}$ in which Dr is the relaxed diameter of the fiber mesh tube and X is the fractional elongation at which the fiber mesh tube exhibits no tensile stress.

18. The bite-safe artificial teat of claim 17 wherein the fibers form a tube.

19. The bite-safe artificial teat of claim 17 wherein the fiber mesh tube is a helically wound braid at about ±15% of the pitch $P_r$ for a specific diameter.

20. The bite-safe artificial teat of claim 17 where the fibers are bonded at crossover points.

21. The bite-safe artificial teat of claim 17 wherein in the fibers form a diamond-pattern mesh.

22. A bite-safe artificial teat comprising:

a nipple portion, formed of an elastomer having a hardness of about Shore A 1 to about Shore A 20, and having at least one duct extending generally longitudinally from a distal end of said nipple portion to a proximal end of said nipple portion;

a base portion attached at the distal end of the nipple portion and having an open interior volume contiguous with the distal end of the at least one duct; and a fiber mesh tube consisting of fibers that extend from the proximal end of the nipple portion through the distal end of the nipple portion for attaching the nipple portion to the base portion without providing tension or compression to the nipple portion during elongation;

where the fibers of the fiber mesh tube are bonded at crossover points and extend distally into the base portion, wherein proximal fibers are fibers of the nipple portion and distal fibers are fibers of the base portion, wherein proximal fibers are less frequently bonded at crossover points than the distal fibers, and wherein the distal fibers splay out and have more crossover points throughout the base portion.

* * * * *